US007829015B2

(12) United States Patent
Kuplen et al.

(10) Patent No.: US 7,829,015 B2
(45) Date of Patent: Nov. 9, 2010

(54) FORMATION OF NON-AXIAL FEATURES IN COMPACTED POWDER METAL COMPONENTS

(75) Inventors: Sean T. Kuplen, Ithaca, NY (US); Matthew W. Crump, Cortland, NY (US); John D. Sarick, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 771 days.

(21) Appl. No.: 11/755,993

(22) Filed: May 31, 2007

(65) Prior Publication Data

US 2008/0298996 A1 Dec. 4, 2008

(51) Int. Cl.
*B22F 3/035* (2006.01)

(52) U.S. Cl. ..... 419/66; 419/5; 75/770; 425/78

(58) Field of Classification Search ..... 419/66
See application file for complete search history.

(56) References Cited

U.S. PATENT DOCUMENTS

| | | | | |
|---|---|---|---|---|
| 2,890,487 | A * | 6/1959 | Morin | 425/468 |
| 3,200,442 | A * | 8/1965 | Haller | 425/78 |
| 4,087,221 | A | 5/1978 | Munson et al. | |
| 4,255,103 | A | 3/1981 | Rozmus | |
| 4,834,940 | A | 5/1989 | Krall | |
| 5,378,416 | A | 1/1995 | Kishi et al. | |
| 5,503,795 | A | 4/1996 | Hubbard | |
| 5,701,574 | A | 12/1997 | Deflinger et al. | |
| 6,099,772 | A | 8/2000 | Hizmann et al. | |
| 6,318,986 | B1 | 11/2001 | Hinzmann et al. | |
| 6,444,167 | B1 | 9/2002 | Shimodaira et al. | |
| 6,592,809 | B1 | 7/2003 | Anderson et al. | |
| 6,919,041 | B2 * | 7/2005 | Dvilis et al. | 419/38 |
| 6,986,866 | B2 | 1/2006 | Gubanich et al. | |
| 2006/0131775 | A1 | 6/2006 | Hicklen et al. | |
| 2006/0280641 | A1 * | 12/2006 | Cooper | 419/66 |

FOREIGN PATENT DOCUMENTS

| | | |
|---|---|---|
| JP | 62146599 | 9/1987 |
| JP | 09001400 | 1/1997 |
| JP | 09194903 | 7/1997 |

OTHER PUBLICATIONS

PCT Search Report; PCT/US2008/064935; Oct. 22, 2008, 9 pages.

* cited by examiner

*Primary Examiner*—Roy King
*Assistant Examiner*—Christopher Kessler
(74) *Attorney, Agent, or Firm*—Brown & Michaels, PC

(57) ABSTRACT

An apparatus and process for forming compacted powder metal parts having a non-axial undercut feature. An undercut die is located between the upper and the lower dies and contains a plurality of shaped punches aligned in a circular pattern. Each of the shaped punches contains a working edge. The working edges converge to form an inner circumference which creates the undercut feature. The edges of the shaped punches slide with respect to each other to change the size of the inner circumference from a maximum diameter position to a minimum diameter position. During compaction, the rotation of the shaped punches alters the inner circumference to its minimum diameter position thereby forming an undercut in the final compacted part. The retraction of the shaped punches to its maximum diameter position enables the unimpeded removal of the part from the tool set.

48 Claims, 13 Drawing Sheets

FORMATION OF NON-AXIAL FEATURES IN COMPACTED POWDER METAL COMPONENTS

BACKGROUND OF THE INVENTION

1. Field of the Invention

The invention pertains to the field of forming metallic parts by compaction of powder metal. More particularly, the invention pertains to a novel apparatus and process to create substantially circular or eccentric undercuts that are perpendicular to the axis of the tooling ejection movements.

2. Description of Related Art

Powder metal compaction processing has led to the ability to manufacture workpieces having a variety of shapes and configurations without having to further machine certain features or dimensional characteristics into these workpieces. Powder metal compaction has become a popular means for producing gears having circumferential or even helical rows of teeth. One essential factor that must be taken into consideration, when designing the dies used to make such components or in selecting what type of component is to be made by this process, is that after the compaction process has formed the part, the dies must be capable of separating and freely ejecting the part.

Conventional powder metal compaction generally consists of a compaction press that houses a tool set. A typical tool set consists of a single die containing a cavity in the shape of the desired end product, one or more bottom punches to facilitate the formation of features on the bottom side of the product, one or more top punches to facilitate the formation of features on the top side of the product, and a core rod to facilitate the formation of one or more series of shaped inner diameters. Variations of this typical tool set may be employed to obtain variations in product shape.

One such tool set variation to compact a part out of powder material uses an upper die and a lower die. Each die houses at least one moveable punch that is capable of moving axially in response to pressure exerted in the axial direction by a compaction press. With this method, the bottom die and top die are initially positionable in contact with a lower punch engaged in the lower die to create a cavity for receiving powder material when the dies are in the closed position and the top punch is raised and separated from the top die. A powder feedshoe carries powder across the top surface of the top die and powder fills the cavity then created by the top die, the bottom die and the bottom punch. The feedshoe is retracted and the top punch is then introduced into the top die to start the compaction process.

One problem that has traditionally limited the broader use of powder metal compaction manufacturing is that the process generally produces workpieces that consist of features sculpted by the combination of the movement of the dies, the movement of the punches, and the process of removing the finished product wherein such movements are only performed in the axial direction. Workpieces having desired non-axial features, such as undercuts, are nearly impossible to produce without having to add secondary processing, such as machining or grinding, after the compaction process to remove material to create such features. Such examples of workpieces having non-axial features are circular shaped gears having at least two rows of circumferential teeth that are separated by a circumferential undercut. It is highly desirable to be able to produce such a part by a single process, such as a powder compaction process alone, rather than having to perform supplemental machining or grinding operations on the compacted part.

Attempts have been made to provide undercuts in powder metal compacted parts. One such process is disclosed in U.S. Pat. No. 4,087,221 in which a powder metal die is used to produce a part having undercut portions that are formed by using removable inserts. This process still requires additional operating steps since the inserts must be manually removed from the finished part after the completion of the compaction process. A variation on this concept is disclosed in U.S. Pat. No. 4,255,103. In this patent, annular flanges are formed in circular parts by the use of shaping inserts. However, once the part is removed from the compaction die, the shaping inserts must be removed by additional processing such as leaching or machining.

A recent approach to resolving the problem of providing undercuts in workpieces such as gears having dual rows of teeth is shown in U.S. Pat. No. 5,378,416. Disclosed therein is a die set consisting of a lower die, an upper die and a "cam die" that moves laterally across the top surface of the lower die. As the compaction process begins, the upper die punch and the lower die punch move axially toward each other to compress the powder metal in the cavity while the two opposing segments of the cam die move laterally toward each other to form a circumferential undercut between two rows of teeth. The problem with this design is that since the two cam die segments move toward each other along a single axis, differences are created in the density of the compacted powder metal part between the portions of the part adjacent the centers of each hemispherically shaped cam and the portions of the part adjacent the points of contact between the two cam dies. The density variance contributes to the uneven distribution of stresses on the part which can lead to premature fracturing and a shorter life cycle. In addition, upon the retraction of the two cams away from the die cavity after compaction of the part, the different portions of the cams move differently against the finished part. The centers of each cam slide radially away from the finished part while the ends of each cam slides away in a substantially tangential direction. These different sliding movements create different stresses on the workpiece with which each die portion is in contact until fully disengaged from the part. This difference may create the potential for the formation of unpredictable patterns of stress fractures. Further, if the laterally moving cam dies fail to meet completely, a gap is created which results in the formation of a "tab" or seam of excess material that must be removed by such means as machining.

SUMMARY OF THE INVENTION

The present invention is an apparatus and process for compacting powder metal parts that have a non-axial undercut feature. A conventional powder metal compaction press and a tool set consists of an upper die, a lower die and axially movable punches within each die. The abutment of the upper die with the lower die forms a cavity in the shape of a desired workpiece. The invention consists of an undercut die positioned between the bottom surface of the upper die and the top surface of the lower die. The undercut die contains a plurality of shaped punches aligned in a circular pattern. The tips of the shaped punches converge to form an inner circumference. The shaped punches move with respect to each other to change the size of the inner circumference from a maximum diameter position to a minimum diameter position to form the non-axial feature.

In operation, an amount of powder metal is charged to the cavity that is created between the upper die, lower die, lower punch, and undercut punches. The upper punch and the lower punch are movable axially toward each other under pressure from the compaction press. Either before the application of pressure or gradually during the application of full pressure, a drive mechanism causes the shaped punches to rotate, urging the inner circumference to move from its position of maximum diameter to its position of minimum diameter within the die cavity. The minimum diameter of the inner circumference is less than the diameter of the walls of one or both dies so that a non-axial undercut is formed in the compacted part perpendicular to the axis of the punch motion and the part ejection motion. Once the compaction process is complete, the drive mechanism rotates the shaped punches in the opposite direction to increase the inner circumference from its position of minimum diameter to its position of maximum diameter. Since the maximum diameter of the inner circumference is greater than the diameter of the walls of the cavity, the shaped punches do not interfere with the ejection motion and resultant removal of the compacted part from the cavity of the tool set.

The present invention provides an apparatus and process for manufacturing compacted powder metal parts having a non-axial undercut or non-axially formed features. The uniform density of the compacted powder metal throughout the entire circumference of the undercut offers structural integrity and functional longevity of the final part.

DETAILED DESCRIPTION OF THE INVENTION

Figure 1A:
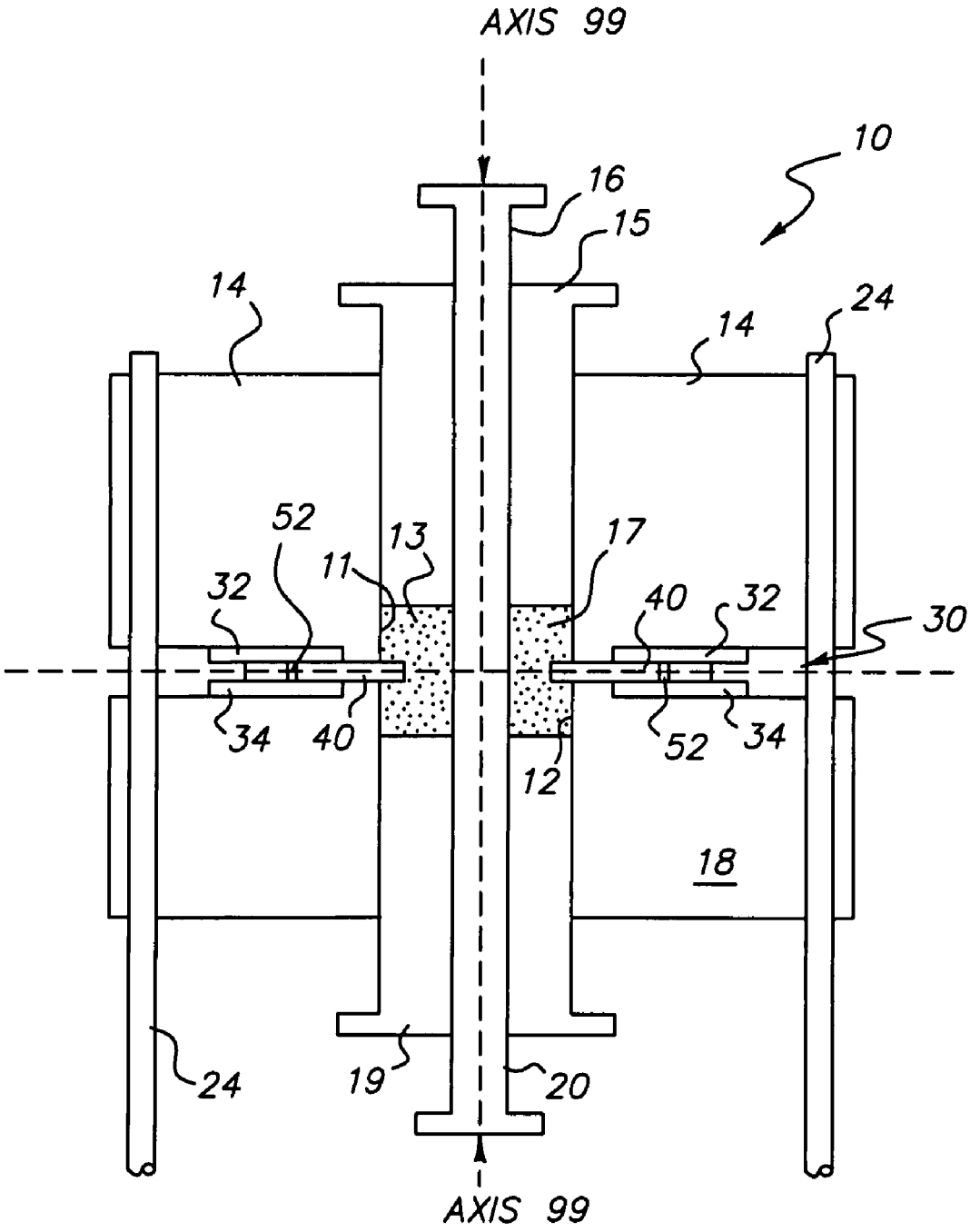
FIG. 1A shows a cross section of a dual punch powder metal compaction tool set having upper and lower core rods after filling with powder metal.
Figure 1B:
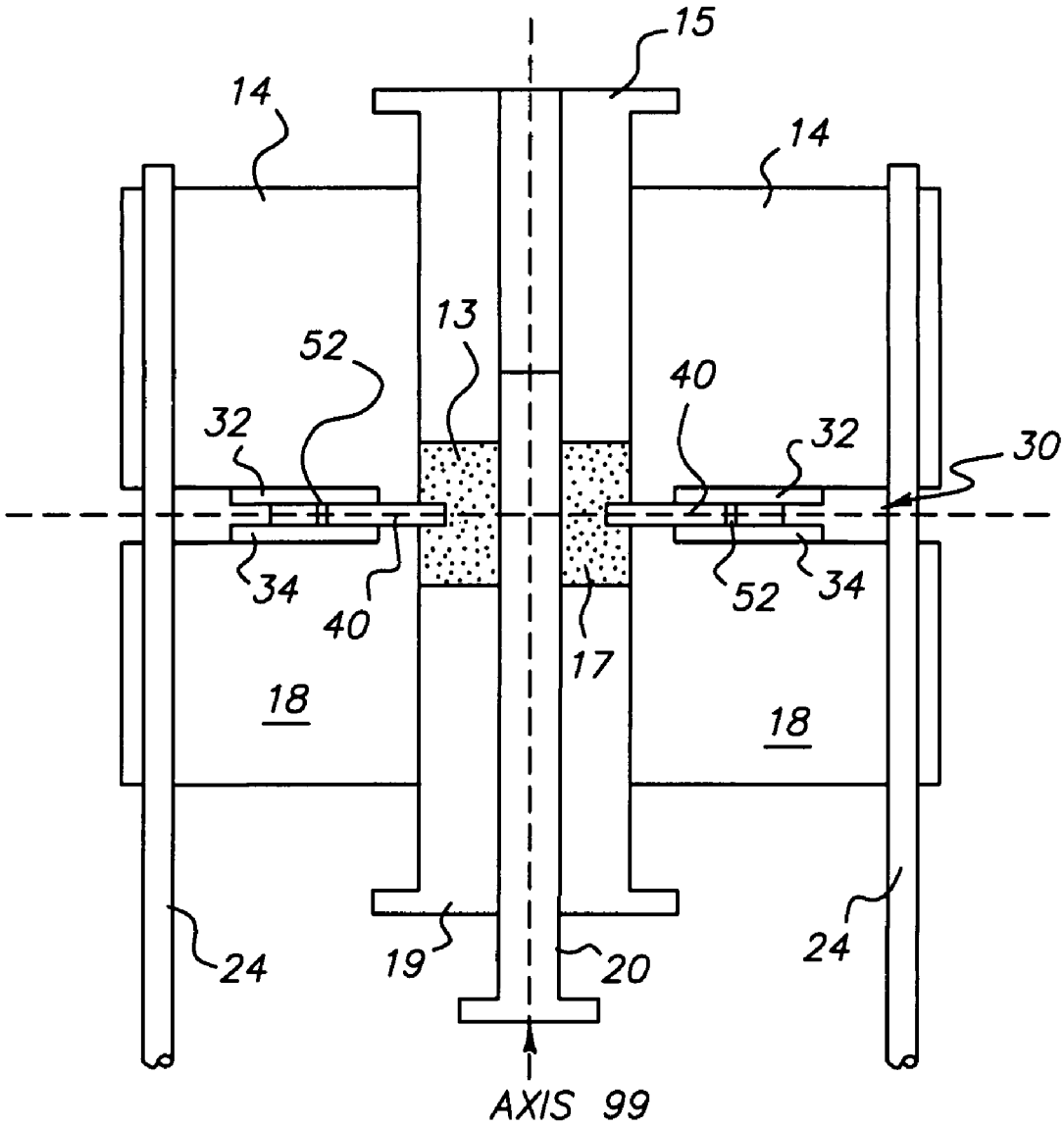
FIG. 1B shows a cross section of a dual punch powder metal compaction tool set having a single lower core rod after filling with powder metal.

The tool set shown in FIGS. 1A and 1B is a cross-sectional view of a conventional powder metal compaction press and provides the background for showing the structure and operation of the present invention. Powder metal compaction press 10 includes an upper die 14 and a lower die 18. A compaction force is applied in both directions along Axis 99. One or more guide posts 24 limit the movement of the dies with respect to one another in the axial direction. Upper die 14 contains a cylindrically shaped upper punch 15 that slidably moves through upper cylindrical bore 11. In the same way, lower die 18 contains a cylindrically shaped lower punch 19 that slidably moves through lower cylindrical bore 12. Cavity 13 is formed between the inner walls of the upper die 14, the lower die 18 and the interior ends of each of the punches 15 and 19. Core rods 16 and 20 converge in the cavity 13 to form a bore through the compacted workpiece. FIG. 1B shows a variation to the tool set displayed in FIG. 1A by having a single core rod 20 to form a bore through the compacted workpiece.

Figure 1C:
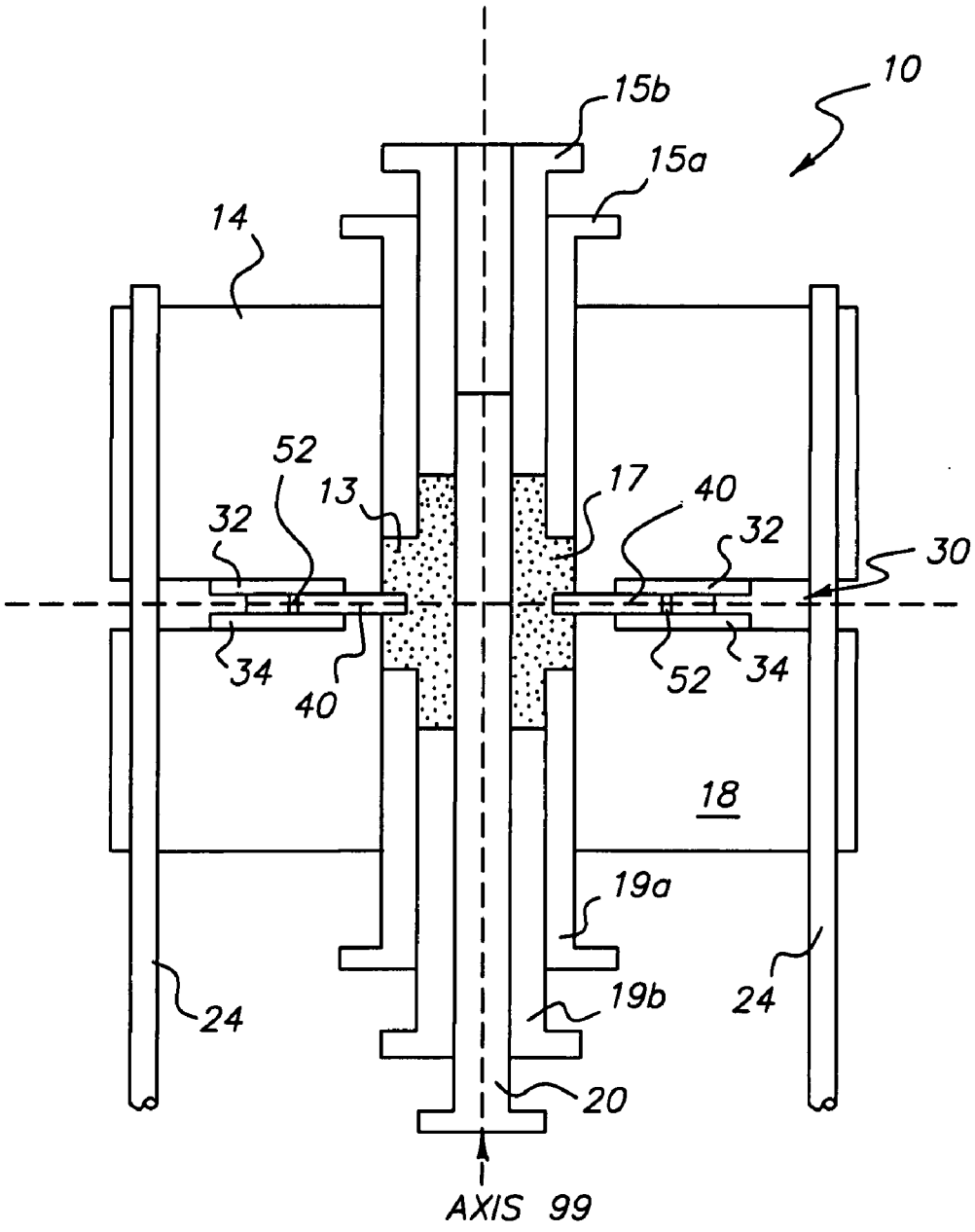
FIG. 1C shows a dual upper punch and dual lower punch powder metal compaction tool set having a single lower core rod after filling with powder metal.
Figure 1D:
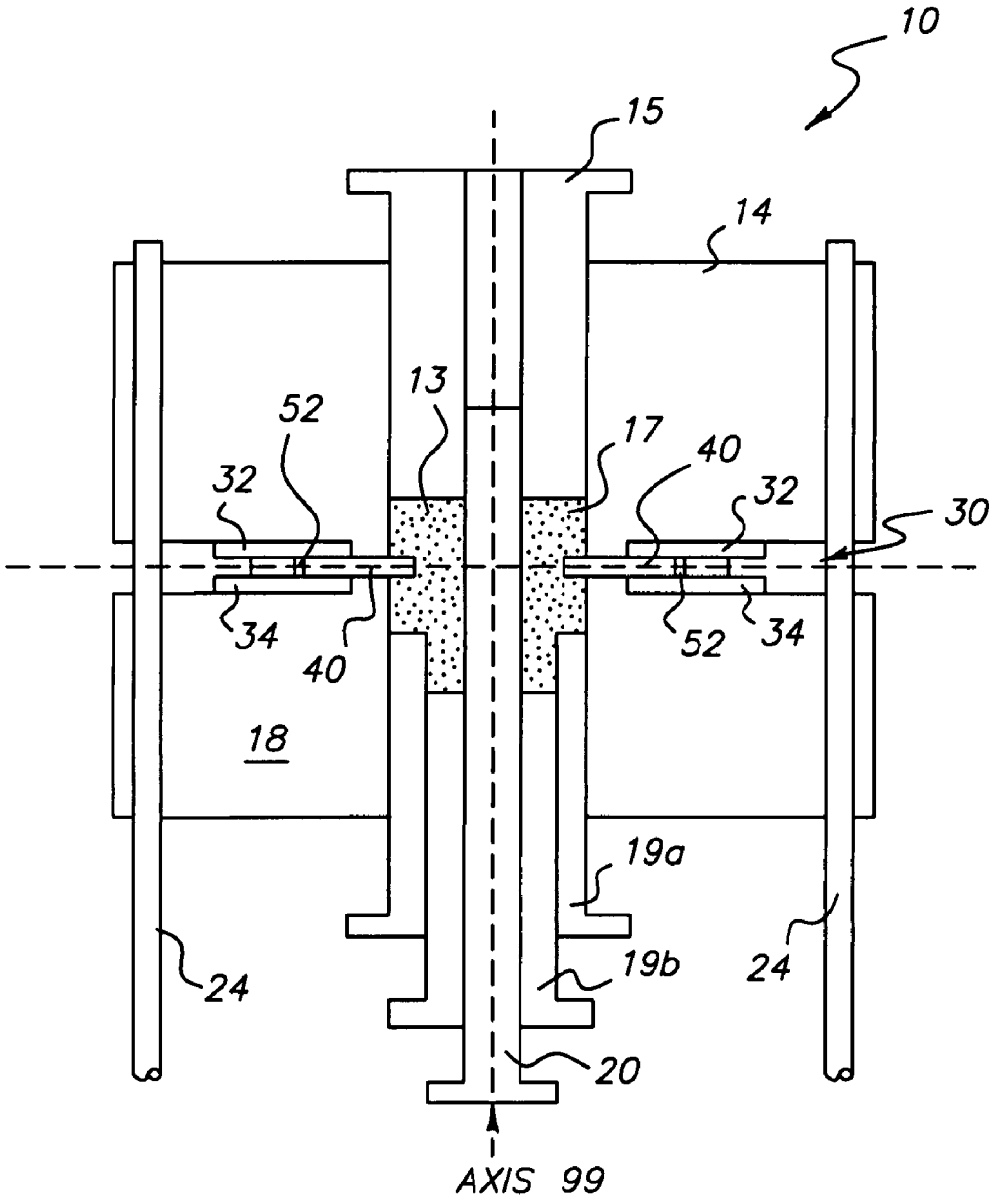
FIG. 1D shows a single upper punch and dual lower punch powder metal compaction tool set having a single lower core rod after filling with powder metal.

Other tool set configurations are shown in FIGS. 1C and 1D. Referring to FIG. 1C a tool set having dual upper punches 15*a* and 15*b* and dual lower punches 19*a* and 19*b* is shown. A single lower core rod 20 is used to create a bore hole through the compacted workpiece. FIG. 1D shows a tool set having only a single upper punch 15 in conjunction with dual lower punches 19*a* and 19*b*. Again, a single lower core rod 20 is used to create the bore through the compacted workpiece.

There are multiple methods that may be used for filling the cavity 13 with powder metal material 17. One of the methods used, for example, might include first separating the upper die 14 from the lower die 18, lowering the lower punch 19 to its lowest position, filling the portion of cavity 13 that lies within the inner walls of the lower die 18, dropping the upper die into full engagement with the lower die and moving the lower punch 19 upward to completely fill the cavity 13 with the powder metal material 17 as the upper punch 15 is moving axially downward. Another method might include retracting the upper punch 15 from the upper die 14 while maintaining contact between the upper die 14 and the lower die 18, pouring the powder metal material 17 through the upper cylindrical die walls 11, then reinserting upper punch 15 into upper die 14. These or any other suitable means known in the art may be employed with the present invention.

Figure 8A:
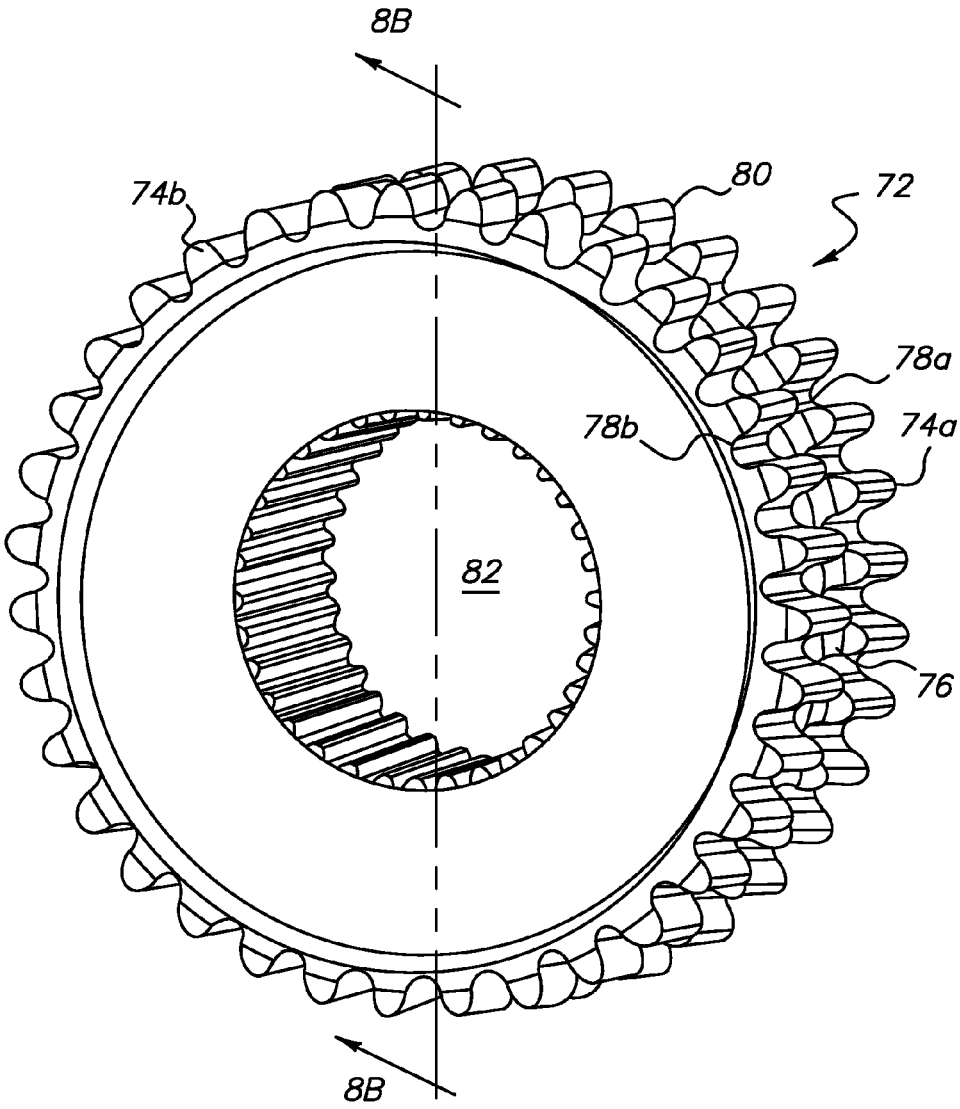
Prior Art FIG. 8A
FIG. 8A shows an isometric view of a sprocket having two rows of teeth.

The apparatus and method of the present invention are capable of forming a non-axial feature in a compacted powder metal workpiece, such as a sprocket 72 (see FIGS. 8A and 8B) without requiring further machining or cutting. A non-axial feature is defined as a shape that can only be formed by tooling that moves in a direction substantially perpendicular to that of Axis 99. The invention is most suitable for manufacturing gears or sprockets having two or more cylindrical rows of teeth requiring an undercut between the rows of teeth. Referring specifically to FIG. 8A, an isometric view of sprocket 72 having two parallel, circumferential rows of teeth 74*a* and 74*b*, is shown. An undercut 76 separates the rows of teeth. The diameter of the undercut 76 is less than the diameter formed by linking the sprocket tooth profile roots 78*a* and 78*b*. The first row of teeth 74*a* is formed in the upper die 14 by teeth shaped cutouts in the upper cylindrical bore 11 adjacent the undercut die 30 and the second row of teeth 74*b* is formed by teeth shaped cutouts in the lower cylindrical bore 12 adjacent the undercut die 30. The rows of teeth may align with each other such that each tooth 74*a* is aligned with a tooth 74*b* and each root 78*a* is aligned with a root 78*b*. Alternatively, the rows may be offset from each other in any phased orientation, mismatched condition, or such that each tooth of one row aligns with a root on the other row of teeth, often referred to as a phased set of sprockets or a MORSE GEMINI™ sprocket. The central hole 82 of the sprocket 72 may be formed by bringing together axially movable core rods 16 and 20 or by passing a single core rod 20 through the cavity 13. In the latter case, the single core rod 20 extends from the lower punch 19 into the upper punch 15. When mating core rods are used, upper core rod 16 is axially movable within upper punch 15 and lower core rod 20 is axially movable within lower punch 19, such that, during compaction of the workpiece, they move axially until they meet within cavity 13.

Figure 3:
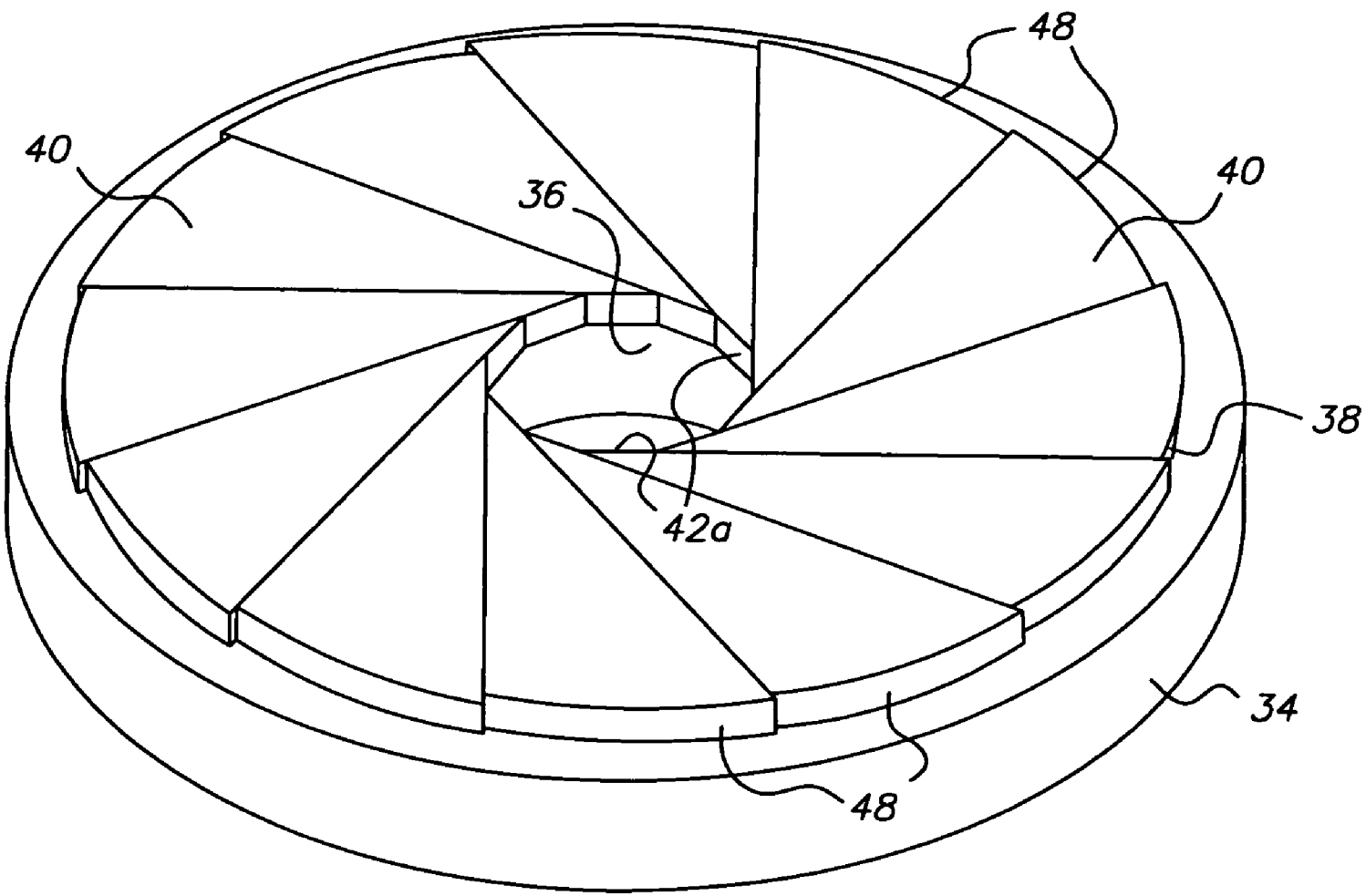
FIG. 3 shows an isometric view of the configuration of the triangular plates of the undercut die.
Figure 5:
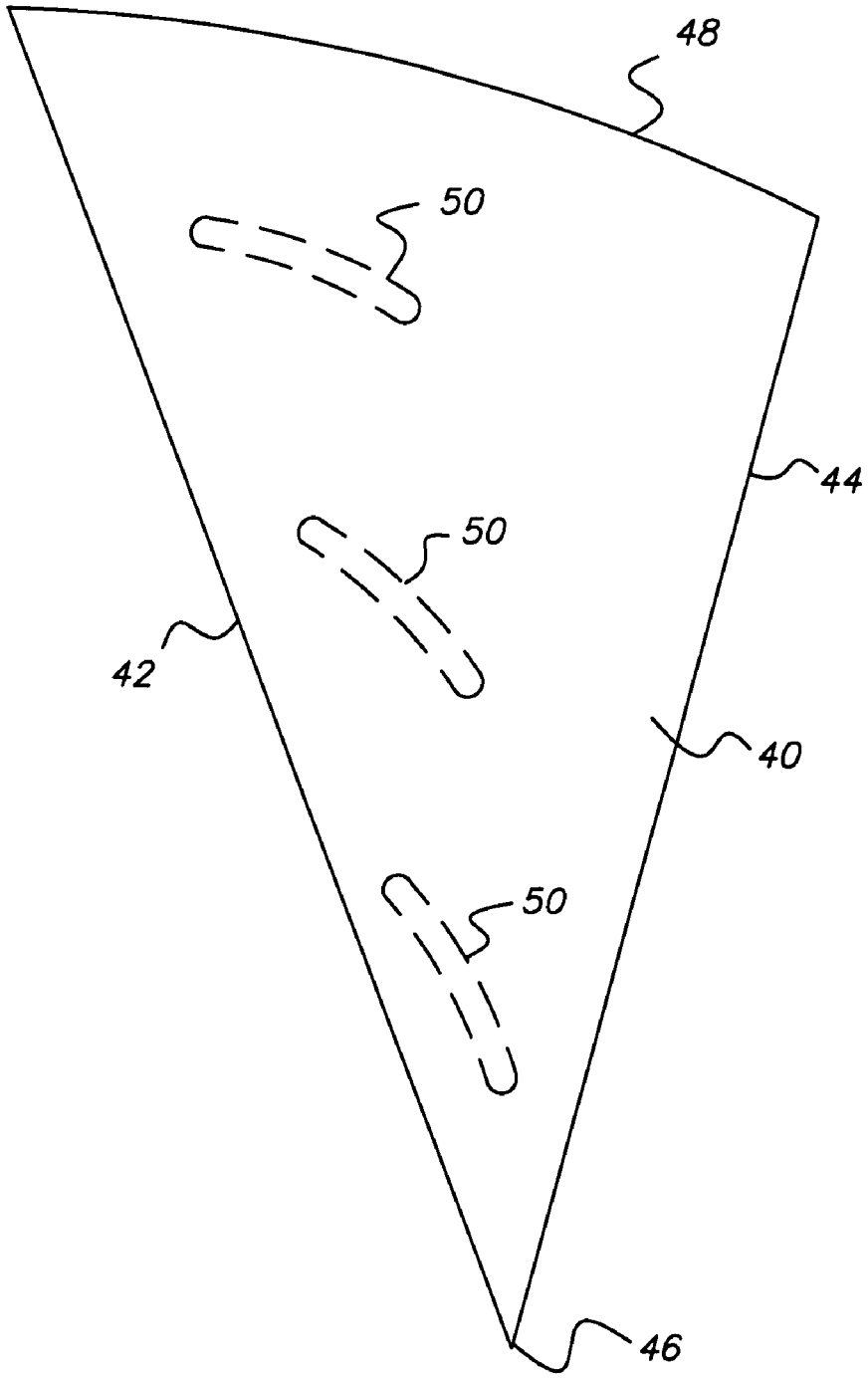
FIG. 5 shows a single triangular plate with potential locations and angles for slots.
Figure 6:
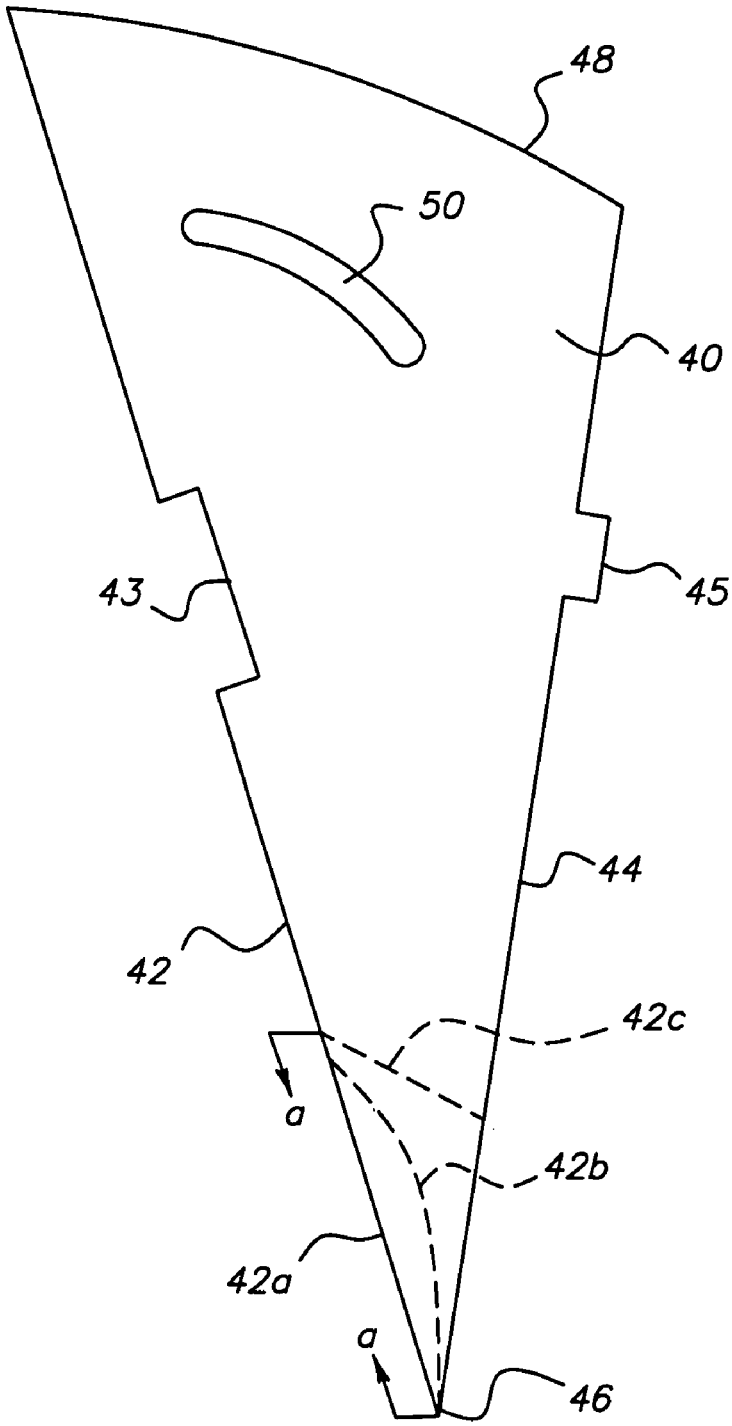
FIG. 6 shows a single triangular plate having interlocking travel limiting means on both its first side edge and its second side edge.

An undercut die 30 (see FIGS. 1A-1D) is positioned between the lower surface of upper die 14 and the upper surface of lower die 18. Undercut die 30 contains an optional upper retaining plate 32 and an optional base retaining plate 34. Between these retaining plates is a plurality of shaped punches 40. Referring to FIG. 5, one example of a shaped punch is shown as having a substantially triangular shape. Each shaped punch 40 contains a first side edge 42, a second side edge 44, a tip 46 and an outer edge 48. The portion of the first edge in proximity to the tip 46 is identified as the working edge 42*a*, as shown in FIG. 6. It may vary in length between line a-a. This is the surface that actually forms the undercut in the workpiece. Working edge 42*a* may take the form of many shapes. It may maintain the straight line of the first edge (42*a*) or it may take a curved shaped, as shown in phantom line as 42*b* or it may abruptly cut off the tip of the shaped punch 40, as shown along phantom line 42*c*. As shown by a schematic representation in FIG. 3, multiple shaped punches 40 are laid out in a circumferential coplanar pattern with the first edge 42 of each shaped punches 40 abutting the second edge 44 of the shaped punch to which it is adjacent. The working edges 42*a* of the shaped punches 40 form an inner circumference. The inner circumference may be substantially circular or polygonal, as dictated by the shapes of the working edges 42*a*. If the undercut is polygonal, the flat segments of the working edges 42*a* may be substantially of equal lengths or they may be of varied lengths. The outer edges 48 of the shaped punches 40 define an outer circumference 38. The number of shaped punches in the undercut die 30 may range from 3 to 300, depending on the size and complexity of the part being produced. Preferably, the number of shaped punches ranges from 6 to 36. Most preferably, the number is approximately 12, but may be less as desired by design requirements.

The shaped punches 40 may not all be identical, especially with respect to their working edges 42*a*. For example, one section of the punches, for example from 60 to 120 degrees of the total circumference, may be shorter than the lengths of the remaining punches in order to form a stepped or non-symmetrical undercut. When utilized on a sprocket, this creates a part whose center of gravity has shifted toward the portion of the undercut that extends further than the remainder of the undercut to form a cam lobe feature. Such parts are suitable for use on counter balance shafts on internal combustion engines, for example. Further, one or more of the shaped punches 40 may be shorter than the remaining punches to generate an outwardly projecting tab or bump that may be employed as a sensor riser, such as for engine timing uses.

Figure 4A:
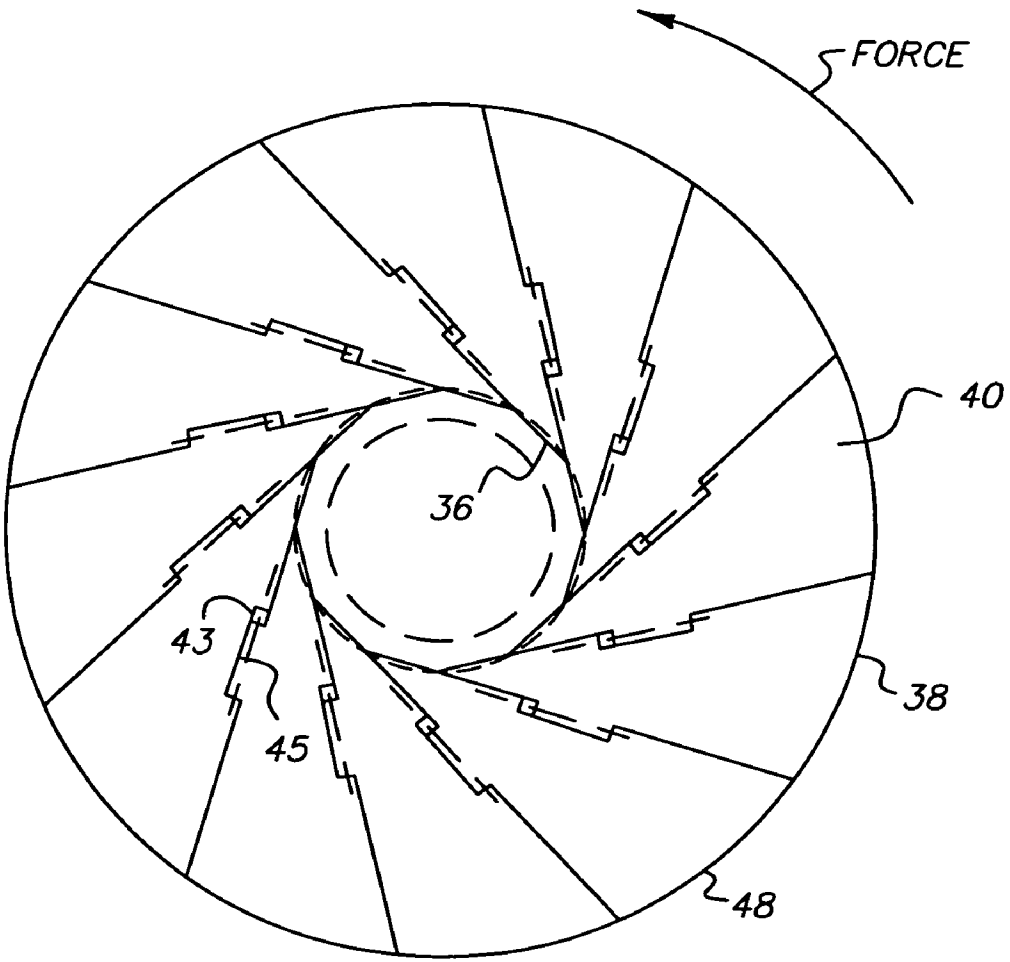
FIG. 4A shows the triangular plates retracted to the maximum diameter of its inner circumference.
Figure 4B:
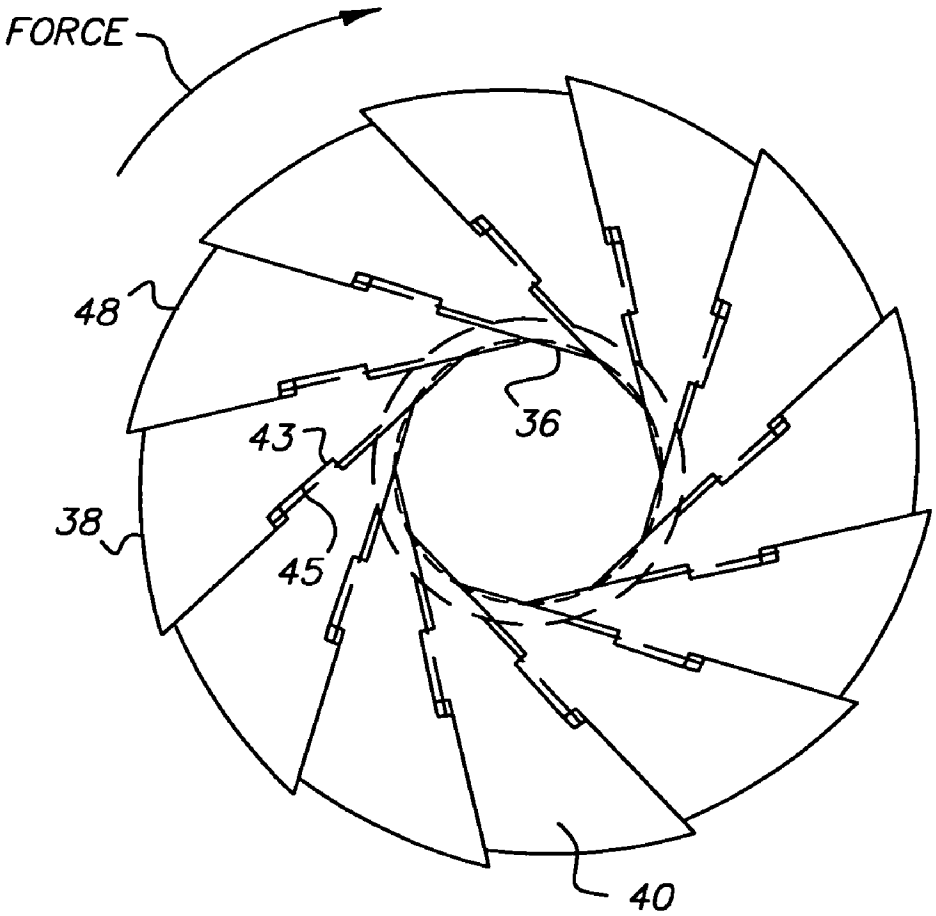
FIG. 4B shows the triangular plates rotated to the minimum diameter position of its inner circumference.

Movement of shaped punches 40 is executed in a rotational manner. The first side edge 42 of each shaped punch 40 slidably abuts the second edge 44 of the shaped punch to which it is adjacent. As shown schematically in FIG. 4A, the inner circumference 36 is at a position of maximum diameter, identified by the solid line, while the outer edges 48 of the shaped punches 40 are aligned at the outer circumference 38. Upon the application of a substantially tangential force on outer edges 48 along the outer circumference 38, as shown in FIG. 4B, the edges of the shaped punches 40 move with respect to one another, reducing the diameter of the inner circumference 36 to a position of minimum diameter, as shown by the solid line.

Figure 2:
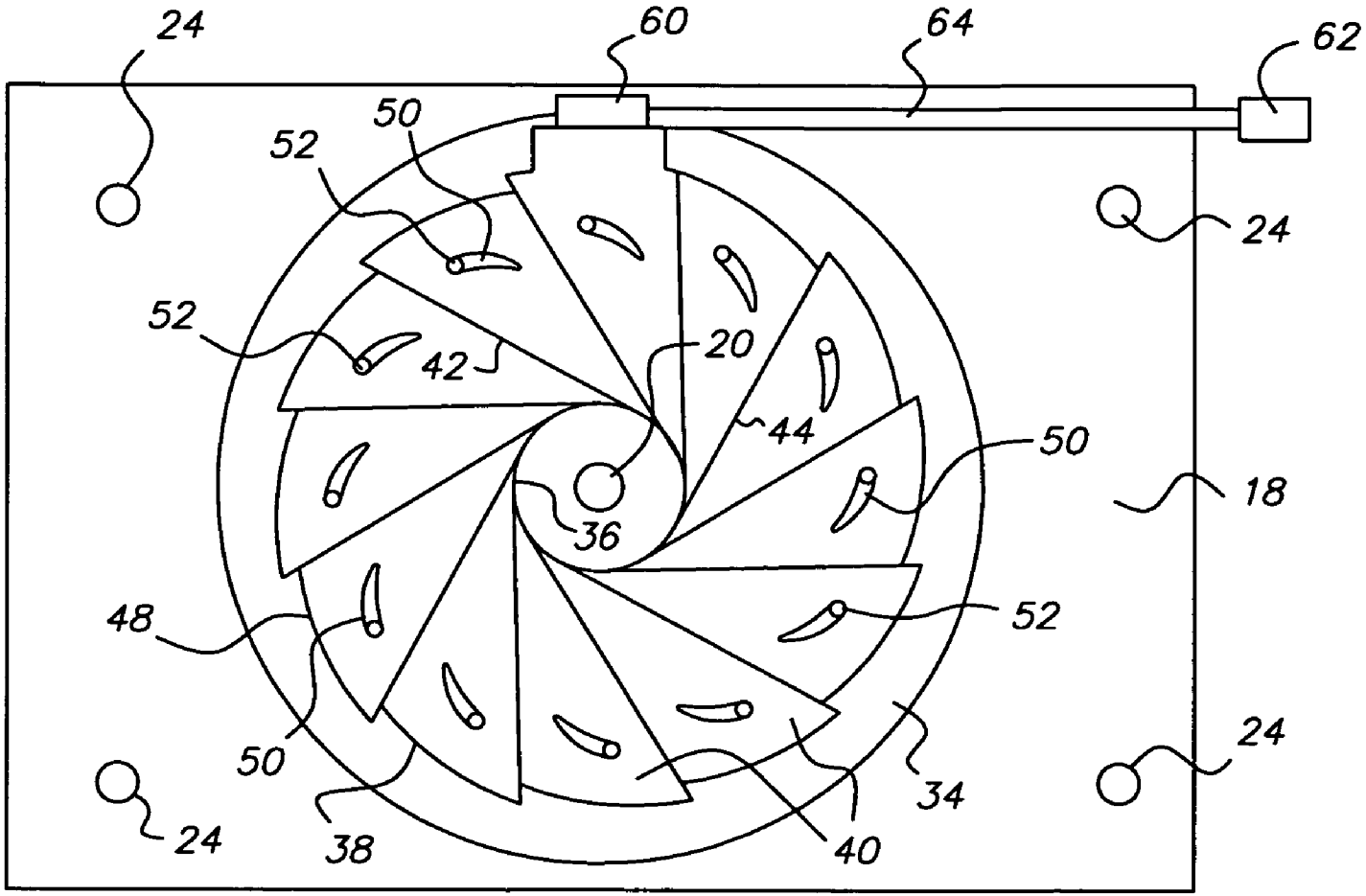
FIG. 2 shows a top plan view of the undercut die of the invention.

Referring to FIG. 2, the operation of the shaped punches 40 within the undercut die 30 is schematically represented. A drive mechanism 60 is used to provide the force necessary to rotate the shaped punches 40. The drive mechanism 60 may be attached to the outer edge 48 of one or more shaped punch 40, as desired. If two drive mechanisms are used, it is advisable to orient them opposite of each other along the outer circumference, substantially 180 degrees from each other. Drive mechanism 60 may be any known device capable of providing rotational movement to the plurality of shaped punches 40. Examples of drive mechanisms include, but are not limited to, a worm gear, an inner/outer gear set, a stepper motor or a hydraulically or pneumatically actuated piston or a chain drive. The power applied by the drive mechanism 60 may be provided by, for example, a servo or hydraulic motor 62 and transmitted to the outer circumference 38 via a connecting shaft 64. The power applied to the drive mechanism 60 may, for example, also be provided by the compaction press using a platen and post extension to activate undercut die 30.

In one embodiment, the movement of the shaped punches is guided and limited by at least one slot 50 formed in each shaped punch 40. As shown in FIG. 5, slots 50 may be located in a variety of locations on the surface of the shaped punches 40, as suggested by the multiple phantom lines. The location of the slots will impact the angle of the slot with respect to the circular path of the outer circumference 38. Slots located in close proximity and generally parallel to the outer edge 48 of each shaped punch 40 will have an angle that curves only slightly away from the angle of curvature of the outer circumference 38 in a substantially circular path. As the location of the slots approaches the tips 46 of the shaped punches 40, the angle of curvature becomes more acute. Slots formed in close proximity to the tip 46 of each shaped punch 40 have a very acute angle that approaches a spiral-like path.

Referring to FIG. 2, pins 52 are securely affixed to either a base retaining plate 34 or an upper retaining plate 32 or they may be permanently affixed to both retaining plates. Each pin 52 is located to fit within each slot 50. When the shaped punches 40 are in their maximum diameter position, each pin abuts one end of the slot within which it is contained. As the drive mechanism 60 applies a force to the outer circumference of the shaped punches 40 to rotate the shaped punches toward their minimum diameter position, the slot moves with respect to the stationary pin 52 until the pin abuts the opposite end of the slot, thus stopping the movement of the shaped punches.

In addition or as an alternative to the slot and pin design described above, the movement of the shaped punches 40 with respect to one another may be limited by an interlocking tab design on the edges of the shaped punches. Referring to FIG. 6, a stop tab 45 on the second edge 44 of each shaped punch 40 interlocks with a channel 43 on the first edge 42 of its adjacent shaped punch 40. The length of the stop tab 45 is less than the length of the channel 43 so that the shaped punches 40 are allowed to move only a limited distance with respect to one another. The full travel of the stop tab 45 within channel 43 correlates to the difference between the maximum diameter and the minimum diameter positions of the inner circumference 36.

Figure 7:
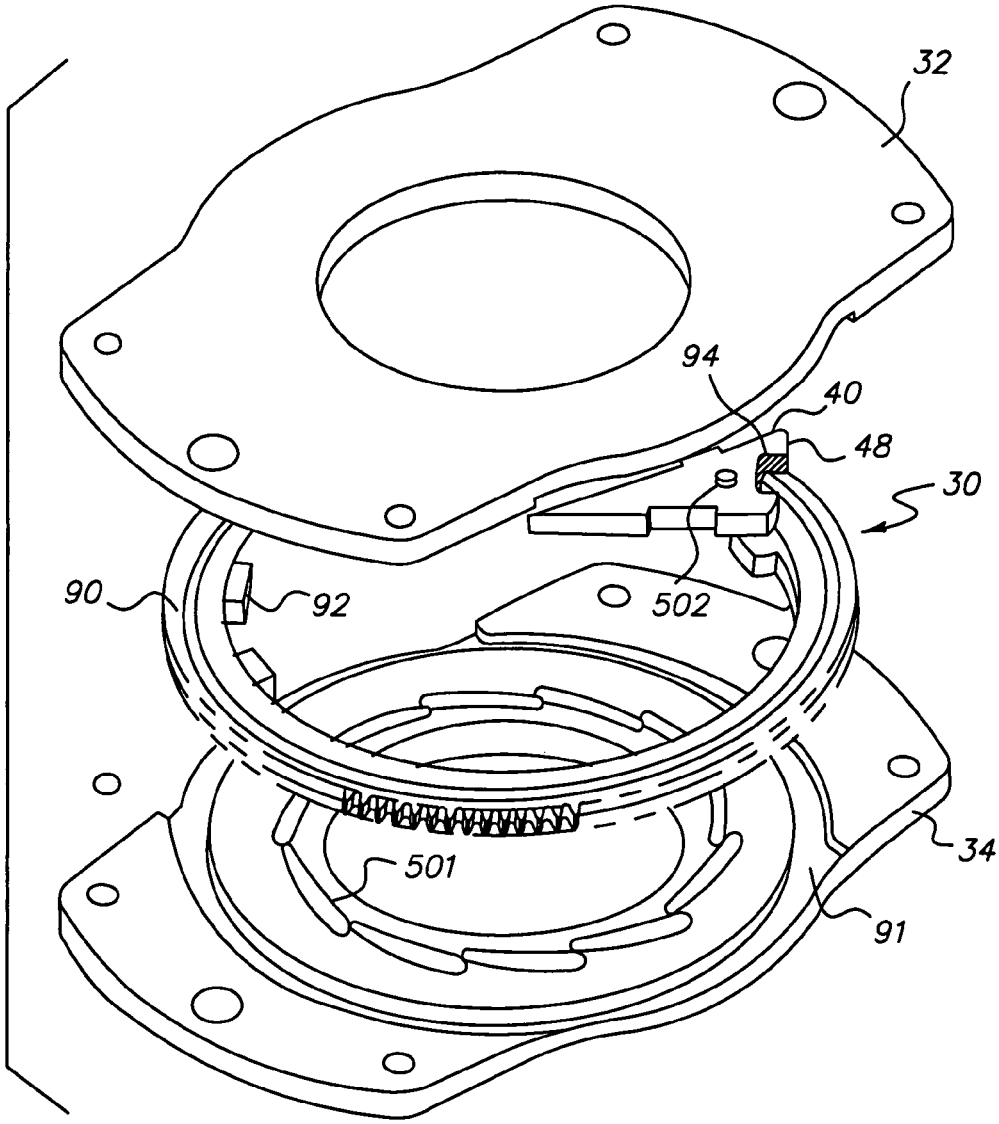
FIG. 7 shows an exploded isometric view of a variation of the rotation means of the undercut die.

A variation of the drive mechanism 60 is shown in an exploded isometric view in FIG. 7. A ring 90 having teeth on its outer diameter and a plurality of guide tabs 92 on its inner diameter is slidably mounted within a groove 91 on the surface of the base retaining plate 34. Each guide tab 92 non-permanently interlocks with a guide slot 94 on the edge 48 of each triangular plate 40. An alternative embodiment of the pin and slot guide means described above is shown in FIG. 7, each triangular plate 40 has at least one pin 502 that slidably engages one of a plurality of slots 501 located on the inner surfaces of both the base retaining plate 34 and the upper retaining plate 32 (not shown in this view). A worm gear or similar such motivating device engages the teeth on the outer diameter of the ring 90 and causes the ring to rotate within the groove 91. As described hereinabove, the rotation of the ring in a first direction urges the shaped punches 40 to move with respect to one another, as controlled by the traversal of each of the pins 502 through its respective slot 501, thereby causing the inner circumference 36 (not shown in this figure) to move from its maximum diameter position to its minimum diameter position. After the completion of the compaction process, the drive mechanism moves the ring in a second direction, opposite from the first direction, causing the shaped punches to move such that the inner circumference retracts from its position of minimum diameter to its position of maximum diameter. During the movement of the ring in the first direction, each of the guide tabs 92 will begin to withdraw from its respective guide slot 94. The guide tabs 92 never fully withdraw from their respective guide slots 94 and thereby limit the lateral movement of the shaped punches 40 during the full range of the travel of the shaped punches between the maximum and minimum diameter positions of the inner circumference 36.

FIGS. 1B, 2, and 8A help best explain the compaction process incorporating an undercut die. The powder metal material is poured into cavity 13 and is then compacted into a compacted part by the application of an externally applied compaction force. As the punches 15 and 19 are transmitting the compacting force to the powder metal 17, the drive mechanism 60 urges the shaped punches 40 to rotate from a position of maximum diameter of the inner circumference to a position of minimum diameter of the inner circumference to form the undercut 76 between the two rows of teeth 74*a* and 74*b*. The rotation of the shaped punches to their minimum diameter position may be completed prior to the application of the compacting force or the shaped punches may gradually be moved to the minimum diameter position as the compacting force is being progressively increased. Reversing the described sequence of movements enables the compacted workpiece to be removed from the toolset. The sequence of the steps just described will be determined by the size and particular configuration of each part manufactured by this process and may be optimized accordingly without deviating from the scope and objectives of the present invention.

Figure 8B:
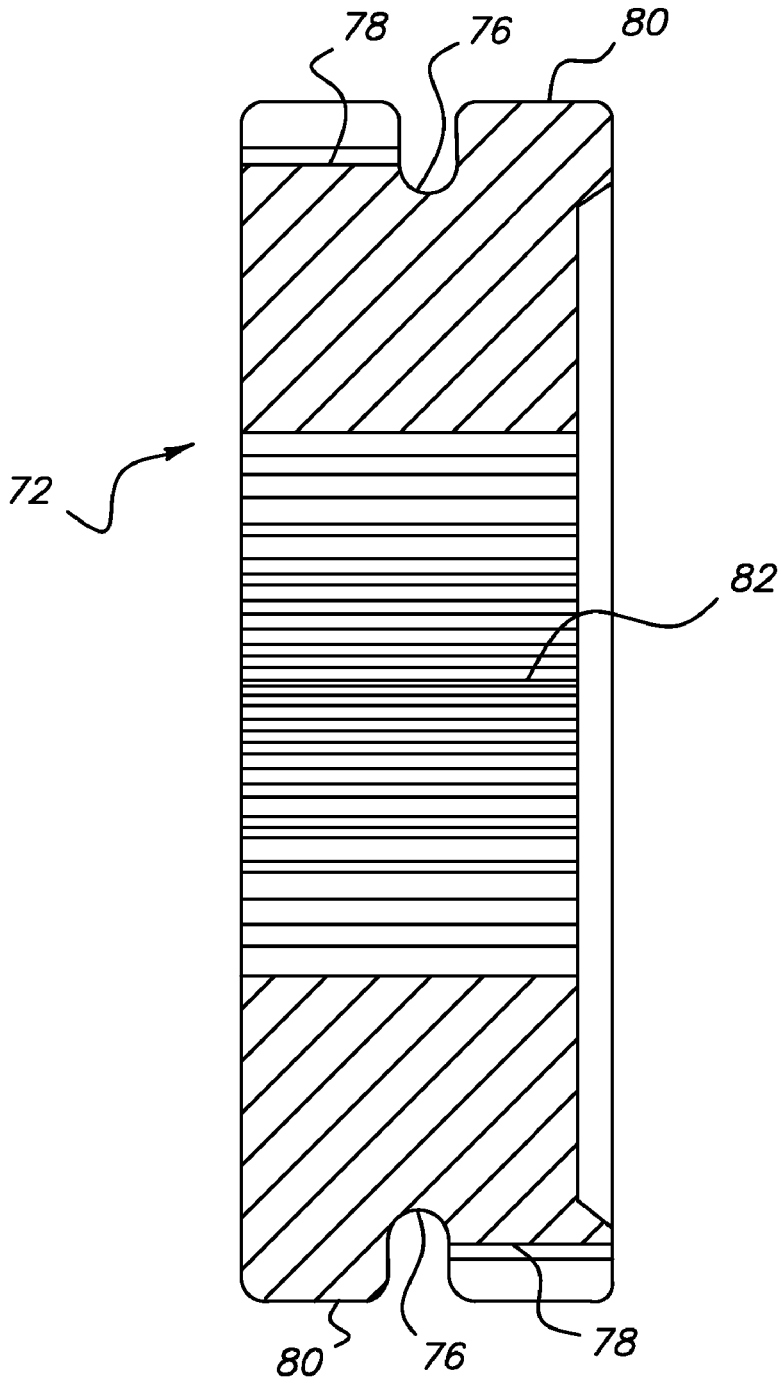
Prior Art FIG. 8B
FIG. 8B is a cross section through line B-B of the sprocket shown in FIG. 8A.

FIG. 8B is a cross section of a conventional sprocket 72 having two rows of offset teeth. Since the rows of teeth shown by this example are offset, this view shows that the diameter of the undercut 76 is less than the diameter formed by an imaginary line linking the troughs 78 between each of the teeth 80.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An apparatus for compacting powder metal into a powder metal part having a non-axial feature using a tool set having an upper die with at least one axially movable upper punch and a lower die with at least one axially movable lower punch comprising:

a) an undercut die positioned between a bottom surface of the upper die and a top surface of the lower die;

b) the undercut die containing a plurality of shaped punches in a circumferential pattern;

c) each shaped punch having an outer edge, a first side edge, a second side edge and a tip;

wherein the outer edge of at least one shaped punch is operatively engaged with a drive mechanism that urges the shaped punches to slide and rotate with respect to one another to form an inner circumference.

2. The apparatus of claim 1 wherein the undercut die is positioned between two retaining plates, the retaining plates identified as a base plate and an upper plate.

3. The apparatus of claim 2 wherein the undercut die and the retaining plates are positioned between two compaction dies.

4. The apparatus of claim 1 wherein the undercut die is positioned between two compaction dies.

5. The apparatus of claim 1 wherein a portion of the first side edge of each shaped punch in proximity to the tip defines a working edge; wherein the first side edge of each shaped punch slidably engages the second side edge of the shaped punch to which it is adjacent.

6. The apparatus of claim 1 wherein the combination of the working edges of all shaped punches forms the inner circumference.

7. The apparatus of claim 6 wherein the inner circumference defines an engineered shape.

8. The apparatus of claim 7 wherein the working edge of each shaped punch is linear so that the plurality of shaped punches of the undercut die forms a substantially polygonal engineered shape.

9. The apparatus of claim 7 wherein the working edge of each shaped punch is curved so that the plurality of shaped punches of the undercut die forms a substantially circular engineered shape.

10. The apparatus of claim 1 wherein the shaped punches are divided into at least two sections wherein the shaped punches of each section are of different lengths in order to form a non-symmetrical non-axial feature in the powder metal part.

11. The apparatus of claim 10 wherein the non-symmetrical non-axial feature is a cam lobe.

12. The apparatus of claim 10 wherein the non-symmetrical non-axial feature comprises outwardly projecting tabs.

13. The apparatus of claim 1 wherein the drive mechanism urges the shaped punches to rotate and slide from a maximum diameter position of the inner circumference toward a minimum diameter position of the inner circumference.

14. The apparatus of claim 2 wherein each shaped punch has at least one upstanding pin that traverses through one of a plurality of curved slots formed in at least one retaining plate with which the pin is engaged to guide each shaped punch to rotate substantially circumferentially between the base plate and the upper plate of the undercut die.

15. The apparatus of claim 14 wherein the plurality of slots is formed in the base plate.

16. The apparatus of claim 14 wherein the plurality of slots is formed in the upper plate.

17. The apparatus of claim 14 wherein the curvature of the slots located in proximity to the outer circumference of the undercut die approximates the path of the circumference of a circle.

18. The apparatus of claim 14 such that the curvature of the slots located in proximity to the inner circumference of the undercut die approximates the path of a spiral.

19. The apparatus of claim 2 wherein the base plate is connected to the upper plate of the undercut die by a plurality of pins.

20. The apparatus of claim 19 wherein each of the pins is slidably engaged within at least one slot formed in each shaped punch to guide each shaped punch to move substantially circumferentially within the undercut die.

21. The apparatus of claim 1 wherein the drive mechanism is a worm gear that operatively meshes with teeth formed on the outer edge of at least one shaped punch.

22. The apparatus of claim 1 wherein the drive mechanism is a hydraulically or pneumatically actuated cylinder having a shaft member connected to the outer edge of the shaped punch with which it is operatively engaged.

23. The apparatus of claim 1 further comprising a second drive mechanism positioned on the outer circumference of the undercut die approximately 180 degrees from the other drive mechanism.

24. The apparatus of claim 2 wherein the drive mechanism contains a ring slidably inserted within a groove on the surface of at least one retaining plate, the ring having an outer diameter containing teeth and an inner diameter having a plurality of guide tabs, wherein each guide tab non-permanently engages a guide slot on the outer edge of each shaped punch.

25. The apparatus of claim 1 wherein the non-axial feature is an undercut between two larger diameter circumferential features of the powder metal part.

26. The apparatus of claim 25 wherein the undercut is substantially circular.

27. The apparatus of claim 25 wherein the undercut is substantially polygonal.

28. The apparatus of claim 27 wherein the polygonal undercut contains segments of substantially equal length.

29. The apparatus of claim 27 wherein the polygonal undercut contains segments having varying lengths.

30. The apparatus of claim 25 wherein the undercut is non-symmetrical.

31. The apparatus of claim 25 wherein the powder metal part is a gear or sprocket having two circumferential rows of teeth located on either side of the undercut.

32. The apparatus of claim 1 having from 3 to 300 shaped punches.

33. The apparatus of claim 32 having from 6 to 36 shaped punches.

34. The apparatus of claim 33 having approximately 12 shaped punches.

35. A method for compacting powder metal into a powder metal part having a non-axial feature comprising the steps of:

a) inserting powder metal into a cavity of a tool set, the tool set comprising an upper die having at least one axially movable upper punch, a lower die having at least one axially movable lower punch and an undercut die located between the upper die and the lower die, wherein the undercut die contains a plurality of co-planar shaped punches forming a circumferential pattern, the circumferentially disposed shaped punches having an outer circumference and an inner circumference, each shaped punch having a first side edge, a second side edge, an outer edge and a tip;

b) moving the upper punch and the lower punch toward each other into the cavity under progressively increasing pressure to form a compacted powder metal part while actuating a drive mechanism to rotate the shaped punches from a maximum diameter position to a minimum diameter position of the inner circumference;

c) rotating the shaped punches from the minimum diameter position to the maximum diameter position while releasing the pressure on the upper and lower punches and retracting them from the cavity; and d) removing the compacted powder metal part from the cavity.

36. The method of claim 35 wherein the undercut die is positioned between two retaining plates, the retaining plates identified as a base plate and an upper plate.

37. The method of claim 36 wherein the undercut die and the retaining plates are positioned between two compaction dies.

38. The method of claim 35 wherein the undercut die is positioned between two compaction dies.

39. The method of claim 35 wherein a portion of the first side edge of each shaped punch in proximity to the tip defines a working edge that combine to form the inner circumference which creates the non-axial feature in the powder metal part.

40. The method of claim 35 wherein the powder metal part is a gear or sprocket having two circumferential rows of teeth.

41. The method of claim 35 wherein the non-axial feature is an undercut between the two circumferential rows of teeth.

42. The method of claim 41 wherein the undercut is substantially circular.

43. The method of claim 41 wherein the undercut is substantially polygonal.

44. The method of claim 43 wherein the polygonal undercut is formed by working edges of the shaped punches, wherein the shaped punches are of substantially equal length.

45. The method of claim 43 wherein the polygonal undercut is formed by working edges of the shaped punches, wherein the shaped punches are of varying lengths.

46. The method of claim 41 wherein the undercut is non-symmetrical.

47. The method of claim 41 wherein the drive mechanism rotates the shaped punches to the minimum diameter position of the inner circumference prior to the application of full pressure upon the compaction die.

48. The method of claim 41 wherein the drive mechanism rotates the shaped punches gradually to the minimum diameter position of the inner circumference to correspond with progressively increasing pressure being applied to the compaction die.

* * * * *